US005137368A

United States Patent [19]

Kistner

[11] Patent Number: 5,137,368

[45] Date of Patent: Aug. 11, 1992

[54] VISCOUS FLUID PUMPING APPARATUS AND SYSTEM

[75] Inventor: Kenneth J. Kistner, Midlothian

[73] Assignee: Specified Equipment Systems Co., Inc., Dallas, Tex.

[21] Appl. No.: 553,648

[22] Filed: Jul. 18, 1990

Related U.S. Application Data

[63] Continuation-in-part of Ser. No. 369,108, Jun. 21, 1989, Pat. No. 5,005,982.

[51] Int. Cl.[5] ..... B01F 5/12

[52] U.S. Cl. ..... 366/272; 137/566; 137/571; 277/27; 366/136

[58] Field of Search ..... 366/136, 272, 137, 262, 366/263, 264, 265, 97, 51, 91, 176, 190, 347; 277/27, 179; 137/566, 571; 222/318

[56] References Cited

U.S. PATENT DOCUMENTS

| | | |
|---|---|---|
| 1,870,192 | 8/1932 | Butler . |
| 1,903,293 | 4/1933 | Isaacson . |
| 2,116,380 | 5/1938 | Bauer . |
| 2,272,309 | 2/1942 | Mott . |
| 2,362,922 | 11/1944 | Palm . |
| 2,474,154 | 6/1949 | Mott . |
| 2,502,563 | 4/1950 | Goodchild . |
| 2,880,455 | 5/1959 | Mineah . |
| 3,142,476 | 7/1964 | Goodwin . |
| 3,152,792 | 10/1964 | Goodwin . |
| 3,229,911 | 1/1966 | Carlson et al. . |
| 3,266,430 | 8/1966 | Mylo . |
| 3,349,713 | 10/1967 | Fassbender . |
| 3,558,282 | 1/1971 | Evans . |
| 3,606,095 | 9/1971 | Kronseder . |
| 4,015,828 | 4/1977 | Gardner et al. . |
| 4,240,567 | 12/1980 | Gardner . |
| 4,479,590 | 10/1984 | Slautterback . |
| 4,514,090 | 4/1985 | Neubauer et al. . |
| 4,592,491 | 6/1986 | Chollet . |
| 4,605,309 | 8/1986 | Albers . |
| 4,635,820 | 1/1987 | Marshall . |
| 4,979,756 | 12/1990 | Krambrock ..... 277/27 |

*Primary Examiner*—Robert W. Jenkins
*Attorney, Agent, or Firm*—Richards, Medlock & Andrews

[57] ABSTRACT

A viscous fluid pumping system having a pair of opposing gears (130, 132) is provided in a housing (32) disposed above an inlet port (73) in a follower plate (70). The follower plate (70) is dimensioned to sealingly fit in a container or drum (D) filled with highly-viscous fluid. In operation, the gears generate a vacuum between the follower plate (70) and the viscous fluid, allowing atmospheric pressure to press the follower plate into the viscous fluid. This, in turn, forces the fluid through the inlet port (73) and into the gears (130, 132). The gears exert high shear forces and localized heating to the fluid, decreasing its viscosity. The fluid exits the system through an outlet in the gear housing. The pumping system may use two such pumps working in conjunction or incorporate a single such pump with a valve structure for recycling fluid through itself.

25 Claims, 6 Drawing Sheets

VISCOUS FLUID PUMPING APPARATUS AND SYSTEM

CROSS REFERENCE TO RELATED APPLICATION

The present invention is a continuation-in-part of application Ser. No. 369,108, filed June 21, 1989, now U.S. Pat. No. 5,005,982, entitled Material Processor.

TECHNICAL FIELD OF THE INVENTION

This invention relates to an apparatus and system for pumping viscous fluids. More specifically, this invention relates to an apparatus and system for pumping highly viscous fluids from drums or containers while improving the rheological and material properties of said fluids, for liquefying semi-solids, or mixing material components by subjecting such materials to extreme pressures, localized heating, shearing and cavitation effects.

BACKGROUND OF THE INVENTION

Materials such as paints, coatings and sealants often have a limited shelf-life. After years or even months of storage, a material's viscosity can increase to a level that the material is unusable. Indeed, the material may have hardened to a point that it can no longer be removed from the can. Disposal of these highly viscous fluids is expensive because they usually must be burned to satisfy environmental protection regulations. The cost of disposal, as well as the cost of the material, could be saved if a device existed which could pump extremely viscous fluids out of their container while at the same time reprocessing them to a reusable condition.

There are also many by-products in the manufacturing of plastics which are highly viscous and present extreme problems with respect to their disposal. For example, a by-product called pyrolysis pitch is produced in the manufacture of polypropylene and polyethylene. This material is a highly viscous material having a viscosity in the range of several hundred thousand centipoise. Because of the inability to remove the material from storage pits in which it is deposited during the manufacturing process, the material has been largely unused. Where the material can be collected, because of the viscosity of the material, it is considered waste and presents a problem and expense with respect to disposal. The material includes high contents of carbon and thus a method capable of pumping and mixing requisite surfactants and other components with the material to both facilitate its removal and subsequent transformation into usable materials, such as fuels, would be extremely beneficial.

Viscous fluids are by definition resistant to flow, and this property causes unique problems when trying to pump such materials. Producing viscous fluid outputs with high volume and pressure can be accomplished by many different types of pumps, if the driving energy is sufficient and the pump materials are properly selected to withstand the forces required to achieve pumping action.

The greatest problem encountered when trying to pump viscous fluids is supplying fluids to the pump unit. The input side of any pump functions as a suction device, in that fluid is drawn into the pump, and surrounding fluid must flow toward the pump to replace fluid that is entering the pump. The greatest suction that can be produced at the pump input is zero pounds per square inch absolute pressure (psia). Trying to operate the pump under conditions to produce greater suction is futile since zero psia represents an absolute vacuum. For example, if the absolute pressure at a pump's input is nearing zero psia and the pump is driven faster, the fluid will merely separate and a vacuum void or cavity will be produced at the input. This input cavitation effect prevents the pump from producing any greater output volume.

Since atmospheric pressure is approximately 14.7 psia and zero psia is the lowest obtainable pressure at the pump input, 14.7 pounds per square inch (psi) is the maximum differential pressure available to force the fluid toward the pump inlet to replace fluid that is being drawn into the pump. This limiting factor of 14.7 psi maximum differential pressure between atmospheric pressure and pump inlet pressure causes very few problems with low viscosity fluids. Because these fluids exhibit relatively low resistance to movement, the available pressure differential is sufficient to allow fluid to flow toward the pump inlet at the same rate as fluid is entering the pump. Only when operating a pump of relatively low volumetric capacity at relatively high cyclic rates do input voids cavitation) present a problem when pumping low viscosity fluids. High viscosity fluids can present a severe problem, however, particularly if large volumes of flow are required. This is because at the maximum available differential pressure, the rate of flow toward the pump inlet is relatively slow due to the high resistance to flow exhibited by the viscous fluids.

Current designs of high volume pumping systems for viscous fluids utilize piston pumps in various configurations. The greatest disadvantage of piston pumps is that while considerable energy is required to maintain the flow of viscous fluids, even greater energy is required to initiate flow due to the requirements of overcoming the inertia of the material. With the conventional piston pump system, the fluid is moved only on one-half of the cycle; thus, fluid flow is initiated once per cycle and halted once per cycle. This halt in fluid flow wastes input energy and requires a relatively large power source to reinstate fluid flow during each cycle.

Conventional design gear pumps can pump viscous fluids only at relatively low volumes because near the input zone, as the gear teeth are parting from the meshed condition, fluid must flow into the void that is created by the parting gear teeth. The fluid must flow into and fill this void before the teeth move to the position where they seal against the pump housing. Viscous fluid flows into this void relatively slowly. To ensure that the pump does not cavitate, it must be initially run at very slow speeds to allow this void to fill.

Where waste or expense is a consideration, fluid pumps for pumping viscous materials will usually be employed with a platen or follower plate. The pump is usually mounted above an orifice through the platen. The platen is sealingly introduced into the shipping container where the viscous fluid is located. As liquid is evacuated, the descending unit scraps down the sides, theoretically causing all of the material to remain in the path of the pump. Additionally, the platen forces the material to the pump to prime it and to keep it primed against the effects of cavitation. Commonly, these results are achieved through the application of external forces by means of a pneumatic or hydraulic ram or mechanical spring-driven rams. The unfortunate consequences of ram-powered platens are (1) the wear and eventual failure of the circumferential seal; (2) severe limitation of portability; and (3) proliferation of systems leading to expensive maintenance and downtime.

An example of a ram-powered platen is found in U.S. Pat. No. 4,592,491 to Chollet. Chollet discloses a device for emptying recipients containing products of high viscosity. A follower plate applies pressure on the contents of a drum by means of vertical tie rods. A scraper system engages the hardened product while heat is applied to soften it. The Chollet device, however, does not reconstitute the material to usable form. Also, the Chollet device requires external force to drive the scraper into the hardened material.

A further example of a platen-pump combination is found in U.S. Pat. No. 4,635,820 to Marshall. Marshall discloses a device which unloads containers of solidified thermoplastic material by heating the material until it softens. The softened material is pumped off of the surface. Springs urge the platen further into the container.

Pumps may also be used to mix additives into viscous or non-viscous fluids. Surfactants are added to decrease the viscosity of materials. Catalysts or other chemical activators, known in the trade as "trippers", are added to a material to allow it to cure more quickly, decreasing the fluid's shelf-life. Unfortunately, trippers are added at the factory long before the sale of the material.

A need exists for a device that can pump extremely viscous materials from a drum or container. The apparatus should also be able to convert the materials to a usable viscosity range without affecting other physical properties of the materials. Such an apparatus should not require the application of any external force on the viscous fluid, nor should it require an external heat source to soften the materials first. Such a pump should also be capable of mixing materials as needed to convert the products to a usable state.

SUMMARY OF THE INVENTION

The present invention relates to a novel viscous fluid pumping system or material processor incorporating driven intermeshing gears with unique design variations and specific conditions of operation that are essential to accomplish its task. The processor includes a housing defining a process chamber and having an inlet for introducing material therein and an outlet for discharging material therefrom. Intermeshing gears are rotatably positioned in the process chamber, and define an area of intermesh which is positioned in the flow path between the inlet and the outlet of the process chamber. A power source is provided for rotating one or both of the intermeshing gears. The mesh between the gears is such that during rotation, a clearance exists therebetween permitting a path between the gears such that material may flow from the discharge side to the inlet side of the gears through the intermesh.

In one embodiment of the invention, the intermeshing gears include a drive process gear and a driven process gear in intermeshing relation. The power source drives the drive gear and a clearance is provided between the drive and driven gears such that at relatively slow speeds, for example 200 rpm, the driven gear is forced ahead of and out of contact with the drive gear by the processed material which is permitted to flow therebetween. However, the gears have intermeshing teeth such that although fluid may flow therebetween, it is subjected to extremely high mechanical forces.

Thus, in the normal operation of the present invention, material is introduced into the inlet and carried by the counter-rotation of the intermeshing gears along a path between the teeth of the gears and the process chamber walls. This flow path communicates with the discharge outlet. However, because of the lash or clearance which is provided between the intermeshing gears, and due to viscous coupling between the material and the gears, a substantial portion of the material passed through the intermesh rather than being discharged through the outlet. This movement of the material through the intermesh zone is a result of viscous coupling between the material and the gears. The material is, therefore, trapped between the intermeshing gears and is subjected to substantial compression, shear forces and cavitation. Thus, unlike a normally operating gear pump, the process gears of the present invention do not form a contacting seal at the point of intermesh but rather one gear floats ahead of the other with a thin layer of the material being positioned therebetween. This gear intermesh relationship of the present invention is incorporated in the related application Ser. No. 369,108, filed Jun. 21, 1989, entitled "Material Processor," the present application being a continuation-in-part of such prior application, the disclosure therein being incorporated herein by reference.

In one embodiment of the invention, a follower plate is used with a diameter equal to that of a standard 55 gallon drum. In another embodiment, the follower plate has a diameter equal to that of a standard 5 gallon drum. The above-described pump is mounted on the follower plate, and a small inlet hole is bored in the center of the follower plate. The pump utilizes this small hole as the inlet port for fluid to flow into the pump and through its discharge port. A hard rubber seal surrounds the follower plate and an inflatable tube is positioned radially inwardly thereof. Hence, a pressure seal can be applied between the follower plate and the surrounding drum by inflating the inflatable tube to expand the rubber seal outwardly and into contact with the container in which it is positioned. This facilitates the integrity of the vacuum created by the pump.

The elastic seal can be formed in variety of geometries and from a variety of materials, such as inflatable elastomeric tubing, a large elastomeric O-ring, elastomeric cup or cone-type seals, or even compressed metal rings similar to automotive piston rings. Final selection of seal geometry and material is dependent on the geometry of the container and the specific material being pumped. In all cases the function of the seal is to cause the follower plate to behave as a piston with the container functioning as the cylinder for the piston. Sealing is only required as the plate moves downward in the container. Thus, edge geometry of the seal is selected to optimize sealing effects when moved in the downward direction.

The follower plate and container can be viewed as an extremely large hydraulic cylinder assembly with the container being the cylinder, the follower plate being the piston, and the fluid being pumped by hydraulic fluid. As fluid is displaced from the cylinder, the plate, behaving like a large diameter hydraulic piston, is drawn downward with considerable force as the fluid is removed. If the suction at the pump is only 5 psi lower than the atmospheric pressure of the ambient atmospheric pressure, then the 5 psi differential pressure acts on each square inch of the surface area of the plate. In typical applications, the plate has several hundred square inches of total surface area, thus the downward force exerted on the plate until it contacts the fluid can easily be several thousand pounds.

As fluid is removed from the container by the pump, the surrounding fluid begins to flow toward the pump and flow paths are established in the fluid. The pump is best started at low speeds until the flow paths become established since overcoming the inertia of the static fluid requires considerable energy and the initial resistance to flow is more likely to cause pump input cavitation when started at high speeds. As flow begins, pump speeds can be increased since much less energy is required to maintain flow or to slow the increased flow than is required to initiate flow. The problem of cavitation at the pump inlet is lessened once flow is established.

In another embodiment, two pumping units are run in conjunction with one another. The first unit is lowered onto viscous fluid in a first drum by a hydraulic loader. The output from the first unit is pumped to the second unit's pump which is running in reverse rotation to the first pump. Thus, fluid is pumped from the first drum through both pumps and into the second drum. If further processing is desired, both pumps can have their rotational direction reversed and the fluid pumped from the second drum is then moved through both pumps into the first drum. This cycling can be continued until the fluid is fully processed. Valving then allows the fluid to be dispensed to packaging.

In a variation to this multiple unit pumping system, a 3-way valve is placed in the flow path of the system. This 3-way valve is also connected with a pressurized input line. Additives, such as dyes or trippers, may be injected into the fluid processing flow. This 3-way valve can also be used to direct flow to an ultimate output location, such as packaging.

In yet another embodiment, the output from a single pumping unit is recirculated back into the bottom of the same drum. To accomplish this, a valve using a drop tube is utilized. Output from the pump enters the valve housing. From the valve, the output may either be directed to packaging or into the drop tube. The drop tube allows the output to be circulated to the bottom of the container, allowing uncycled material at the top to be circulated. The configuration allows for the continued cycling of a material until its viscosity reaches the desired level.

BRIEF DESCRIPTION OF THE DRAWINGS

For a more complete understanding of the present invention, and for further details and advantages thereof, reference is now made to the following detailed description taken in conjunction with the accompanying drawings, in which.

DESCRIPTION OF THE PREFERRED EMBODIMENTS

Figure 1:
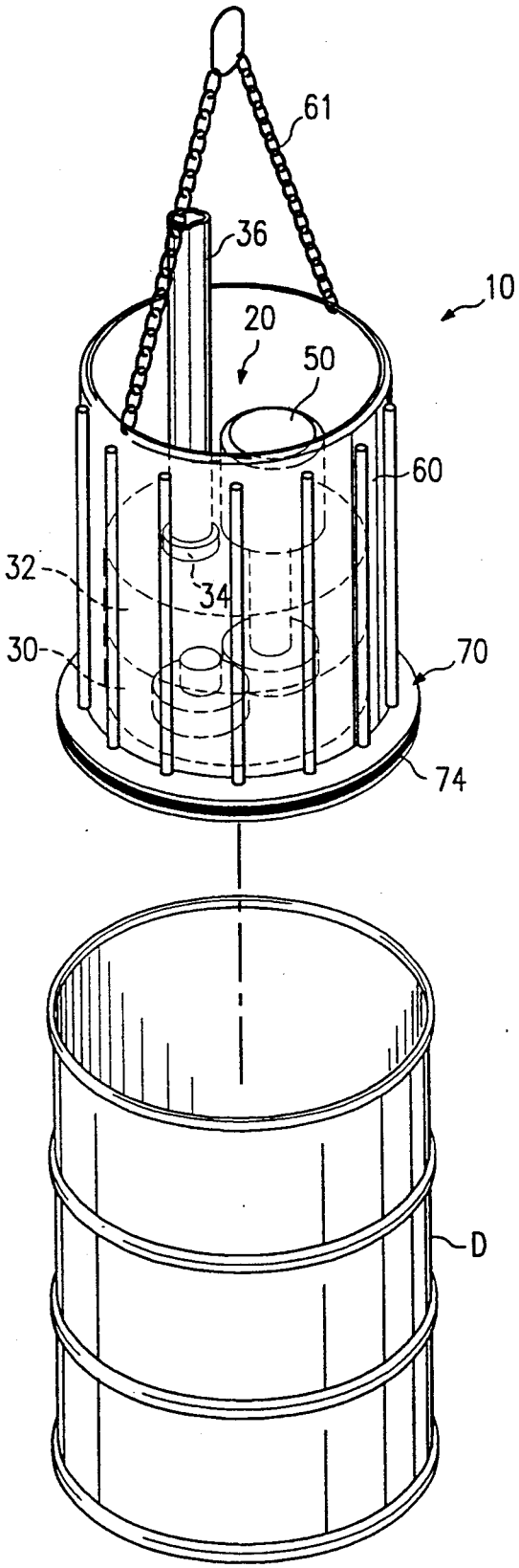
FIG. 1 is a perspective view of the viscous fluid pumping system.

The present invention is to a viscous fluid pumping system that overcomes many of the disadvantages found in the prior art. Referring now to FIG. 1, a perspective view of a pumping system 10 according to the present invention is disclosed. Material processor pump 20 includes a lower housing 30 and an upper housing 32 attached thereto. Upper housing 32 has an exhaust fitting 34 which receives an exhaust pipe 36. A hydraulic drive or torque motor assembly 50 is attached to the upper housing 32.

A follower plate 70 is attached around lower housing 30 and has a circumferential seal 74 on its radially outwardly facing edge. The seal is designed for sealing engagement with the inside surface of a material container D.

Material processor pump 20 is surrounded by a cylinder 60 extending from follower plate 70 and having a circumference slightly smaller than the inside diameter of container D. In one embodiment, pumping system 10 is positioned into container D by a hoist unit (not shown) which is connected to the pumping system by way of chains 62, or other suitable attachment means attached to cylinder 60. If large diameter containers are to be used for processing, then multiple pumping units can be attached at several locations on a large diameter follower plate.

Figure 2:
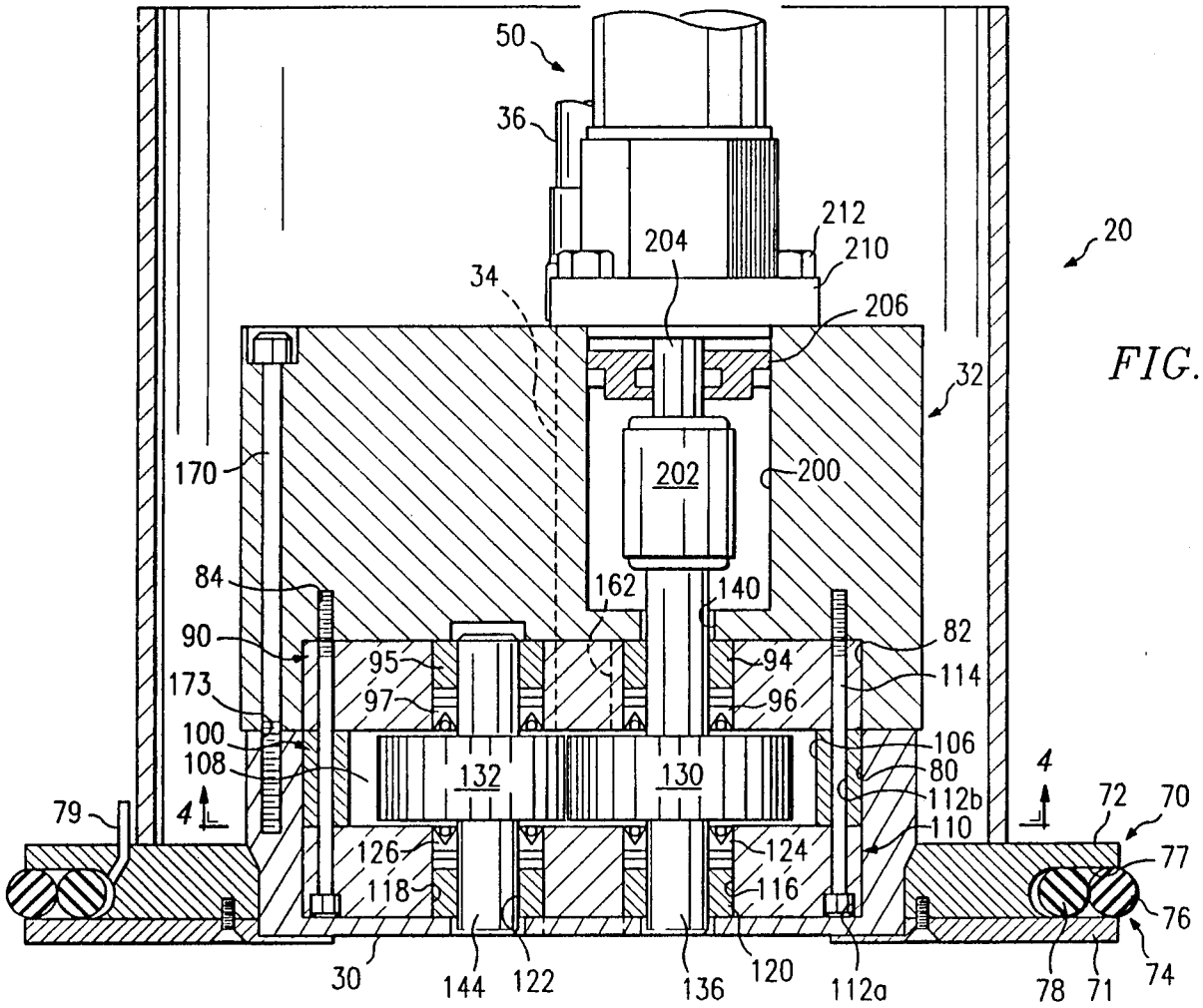
FIG. 2 is a cross-sectional view of the viscous fluid pump used in the system.
Figure 3:
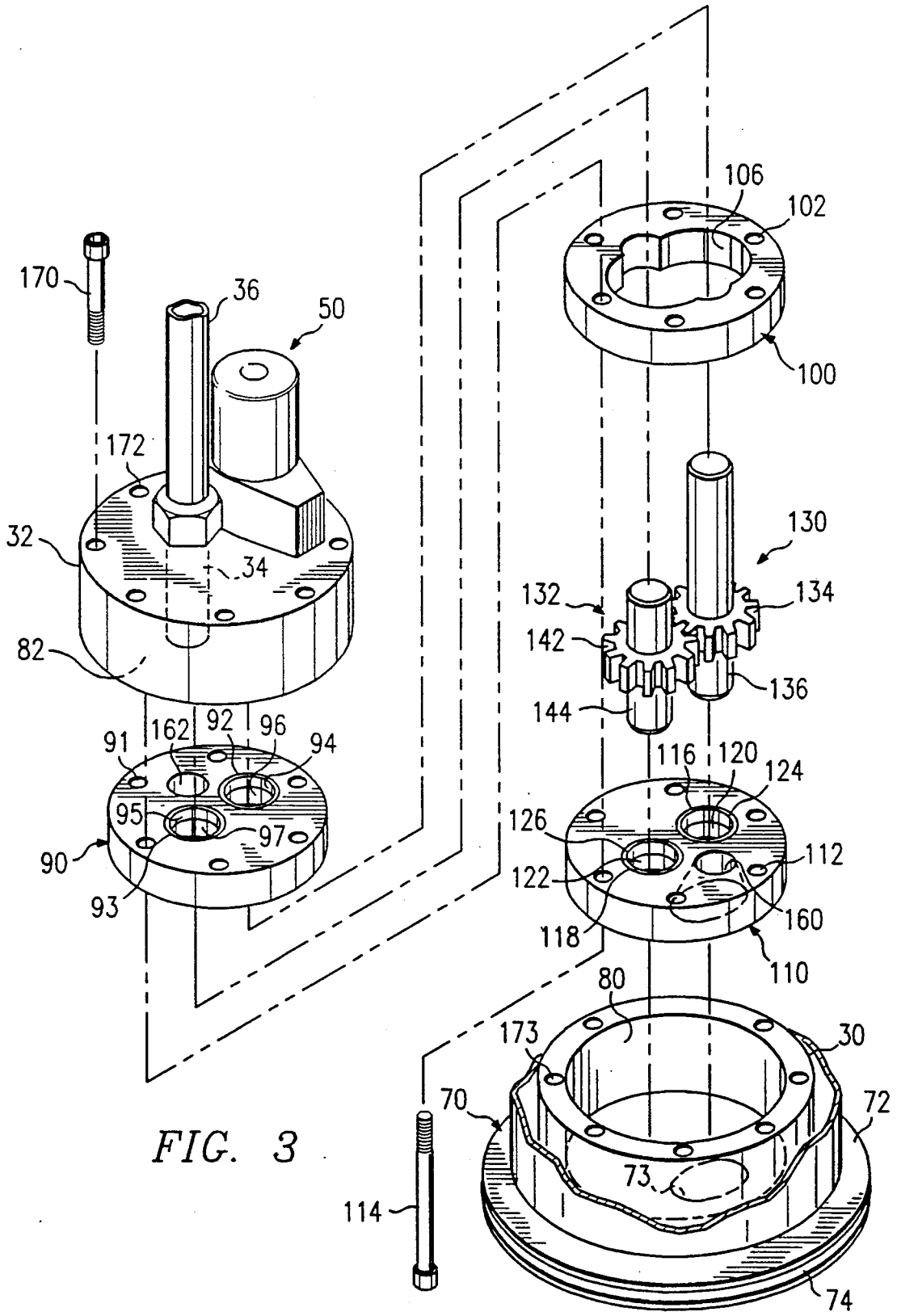
FIG. 3 is an exploded perspective view of the viscous fluid pump.

The details of the pumping system 10 are shown in more detail in the section view of FIG. 2 and the exploded view of FIG. 3. Referring to these figures, seal 74 is positioned in a radially outwardly facing groove 77 defined by a removable face plate 71 attached by appropriate screws to main plate 72. Seal 74 is composed of at least one expandable O-ring 76 and, in a preferred embodiment, a radially inwardly positioned inflatable tube 78. Air valve 79 is used to stiffen inflatable tube 78, thus pressing O-ring 76 outward. As can be seen in FIGURE 2, lower housing 30 is fitted within an opening through main plate 72. Lower housing 30 may be bolted in place to plate 72 or other conventional attachment means can be used. Lower housing 30 has a machined-out cavity 80 which, when assembled to upper housing 32, is aligned with a cavity 82 formed in the upper housing. Upper housing 32 has within it a plurality of threaded holes 84 (FIG. 2) formed about the inner circumference of the base of cavity 82. As is best seen in FIG. 3, a process chamber top plate 90 fits within cavity 82 and has a plurality of holes 91 therethrough which correspond to threaded holes 84. Process chamber top plate 90 also has a pair of holes 92 and 93 therethrough which receive therein bearings 94 and 95 and seals 96 and 97, respectively. A process chamber sidewall plate 100 is positioned below process chamber top plate 90. Plate 100 has a plurality of holes 102 therethrough which correspond to holes 91 in bottom plate 90. Plate 100 has a central opening 106 formed therethrough, which will be described in greater detail hereinafter, to define a process chamber 108 (FIG. 2).

A process chamber bottom plate 110 is mounted below sidewall plate 100 and has an outer shape which corresponds to that of plates 100 and 90. Bottom plate 110 has a plurality of holes 112 formed therethrough which correspond to holes 102 and holes 91 of plates 100 and 90, respectively. As can be seen in FIG. 2, holes 112 in bottom plate 110 have a bored lower portion 112*a* of a greater diameter than upper portion 112*b* to accommodate the bolt head of bolts 114 which are used to assemble bottom plate 110, plate 100 and top plate 90 in the manner shown. Specifically, bolts 114 are threaded into threaded holes 84 in upper housing 32 to secure the three plates in position. Referring again to bottom plate 110, bores 116 and 118 are formed therethrough and receive bearings 120 and 122, respectively. As shown in FIGS. 2 and 3, seals 124 an 26 are fitted in bores 116 and 118, respectively, adjacent the upper face thereof.

As can be seen in FIGS. 2 and 3, a pair of process gears 130 and 132 are assembled between and through bottom plate 110, top plate 90 and sidewall plate 100. Specifically, drive process gear 130 includes a drive gear segment 134 attached for rotation with drive shaft 136. The upper portion of drive shaft 136 is journaled in bearing 94 and extends therethrough and through an opening 140 in the upper housing 32. The lower portion of shaft 136 is journaled in bearing 120.

A second, driven, process gear 132 includes a gear segment 142 fixed for rotation with shaft 144. The upper end of shaft 144 is journaled in bearing 95, fitted in top plate 90, and the lower portion of the shaft is journaled for rotation in bearing 122. As seen in FIG. 3, bottom plate 110 also has an inlet aperture 160 therethrough and top plate 90 has an exhaust aperture 162 therethrough.

Referring to FIGS. 2 and 3, lower housing 30 is mounted to upper housing 32 using bolts 170 which pass through holes 172 (FIG. 3) in the upper housing. The lower housing 30 has a plurality of corresponding holes 173 which are threaded to receive the threaded ends of bolts 170 (FIG. 3). As shown in FIG. 2, when lower housing 30 is assembled with a upper housing 32, cavities 80 and 82 define a chamber in which bottom plate 110, sidewall plate 100 and top plate 90 are positioned. Process chamber 108 is likewise formed by sealing opening 106 with plates 110 and 90 as shown in FIGS. 2 and 3.

Lower housing 30 is positioned such that inlet 160 and opening 73 are aligned so that inlet 160 is exposed to fluid encountered therebelow. Similarly, exhaust 162 is aligned with an opening through the upper housing 32 which communicates to exhaust fitting 34 and exhaust pipe 36.

The connection of torque motor assembly 50 to drive process gear 130 is shown in FIG. 2. Specifically, upper housing 32 has an enlarged bore 200 overlying smaller aperture 140. The upper end of shaft 136 extends through aperture 140 and into enlarged bore 200 and is connected by coupling 202 to torque motor shaft 204. A seal 206 is positioned around shaft 204 within bore 200. Torque motor assembly 50 has a mounting collar 210 which is attached by bolts 212 to upper housing 32.

Figure 4:
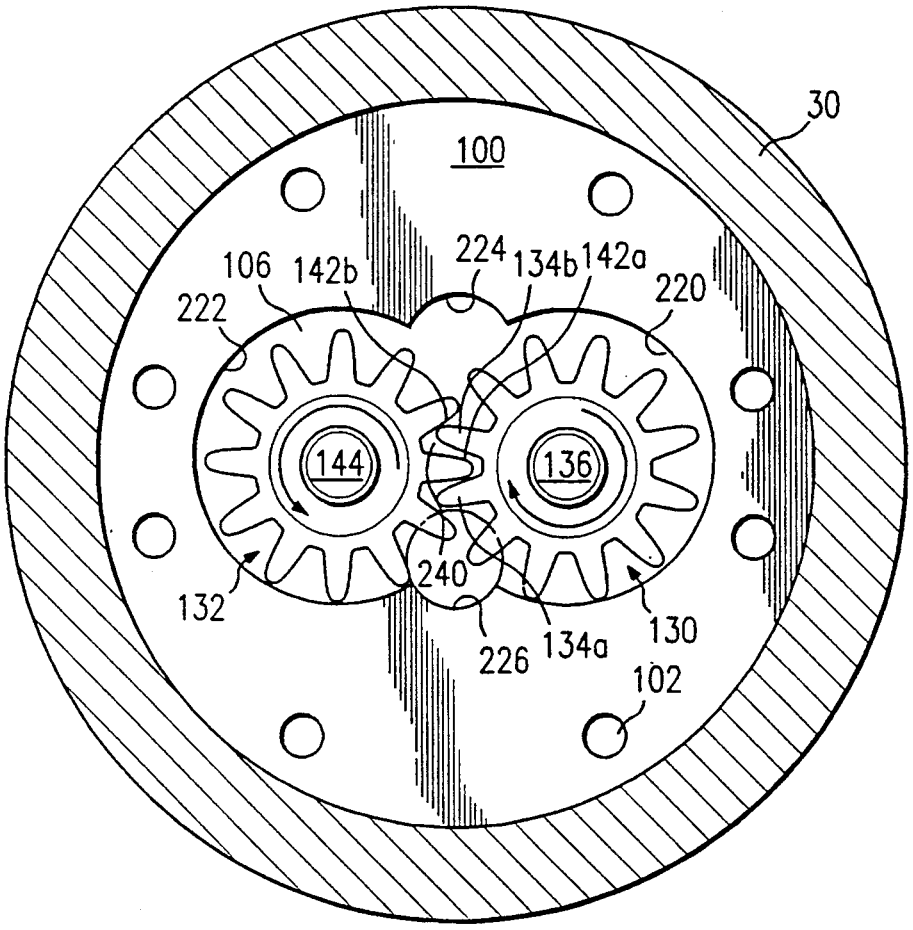
FIG. 4 is a cross-sectional view of the pump taken along line 4—4 of FIG. 2.

FIG. 4 show the relationship between process gears 130 and 132 and between such gears and central opening 106 in sidewall plate 100. Specifically, opening 106 in plate 100 has a pair of arcuate walls 220 and 222 which are, in one embodiment, slightly off concentricity with the axis of rotation of process gears 130 and 132, respectively. Arcuate surfaces 220 and 222 are positioned relative to the axis of rotation of the gears in that the distance between those surfaces and the gear teeth is greater adjacent the inlet than adjacent the exhaust. Process chamber 108 is the chamber defined by sealing opening 106 in plate 100 with plates 110 and 90 as shown on FIGS. 2 and 3.

Referring still to FIG. 4, central opening 106 has a surface 224 which defines a fluid communication path area in line with inlet 160 in bottom plate 110 and a surface 226 which defines a fluid communication path in line with exhaust 162 of top plate 90. It will be understood that while the distance between the gear teeth and the process chamber wall adjacent surface 224 is greater than that between the gear teeth and the process chamber wall adjacent surface 226, the relationship shown in FIG. 4 is significantly exaggerated for purposes of illustration. Specifically, in one embodiment of the invention, the distance between those surfaces and the gear teeth and the process chamber wall adjacent the inlet is on the order of 0.025 in. (0.635 mm) while the distance from the gear teeth outer edge and the process chamber wall adjacent the exhaust is on the order of 0.003 in. (0.076 mm). It will be understood that these clearances can be changed according to the materials being processed.

A significant feature of the present invention is found in the relationship between process gears 130 and 132. As seen in FIG. 4, process gear 130 rotates in a clockwise direction and gear 132 rotates in a counterclockwise direction as seen in FIG. 4. However, unlike a standard gear pump, a total lash of from 0.0015 in. (0.038 mm) to 0.015 in. (0.38 mm) is provided between the gear teeth at the point of intermesh. In other words, the gear teeth are designed such that they do not incorporate a zero or near zero lash as is the case in ordinary gear pumps. This 0.0015 in. lash provides for a possible clearance on either side of any tooth of 0.00075 in. (0.011 mm) at the point of intermesh of the gear teeth. If the processor is used in stages, a first stage processor may be set such that this lash is 0.030 to 0.050 in. (0.762 to 1.27 mm), followed by treating the material by passing it through a processor having a smaller lash.

Thus, in the present invention, material continuously exists between the leading edge of teeth 134*a* and 134*b* and the trailing edge of teeth 142*a* and 142*b* of process gears 130 and 132, respectively. Moreover, material will therefore be trapped in the areas designated by numeral 240 (FIG. 4). This is in contrast to the operation of the normal gear pump wherein the leading surface of teeth 134*a* and 142*a* are in surface-to-surface contact with the trailing surfaces of teeth 134*b* and 142*b*, respectively. Further, the ordinary gear pump is not designed to allow material to flow through the mesh area designated by numeral 240 as in the present invention. Thus, in the present invention, as the material passes through the intermesh zone designated by numeral 240, it is subjected to extreme pressures, localized cavitation, heating and shear which do not occur in any other pumping or processing system. This is accomplished even though, and in part because of, the relatively slow rotation of the process gears.

Although the above defined lash exists between the teeth of gears 130 and 132, as the gears are rotated, a sufficient seal is formed to develop a suction below follower plate 70 and create a vacuum. As this vacuum is formed, atmospheric pressure above the follower plate forces the plate against the viscous material in drum B, causing it to be forced into pump unit 32 for processing. This processing is achieved by the movement of material by the gears and the passage of such material through the mesh zone between the gears as described above.

Figure 5:
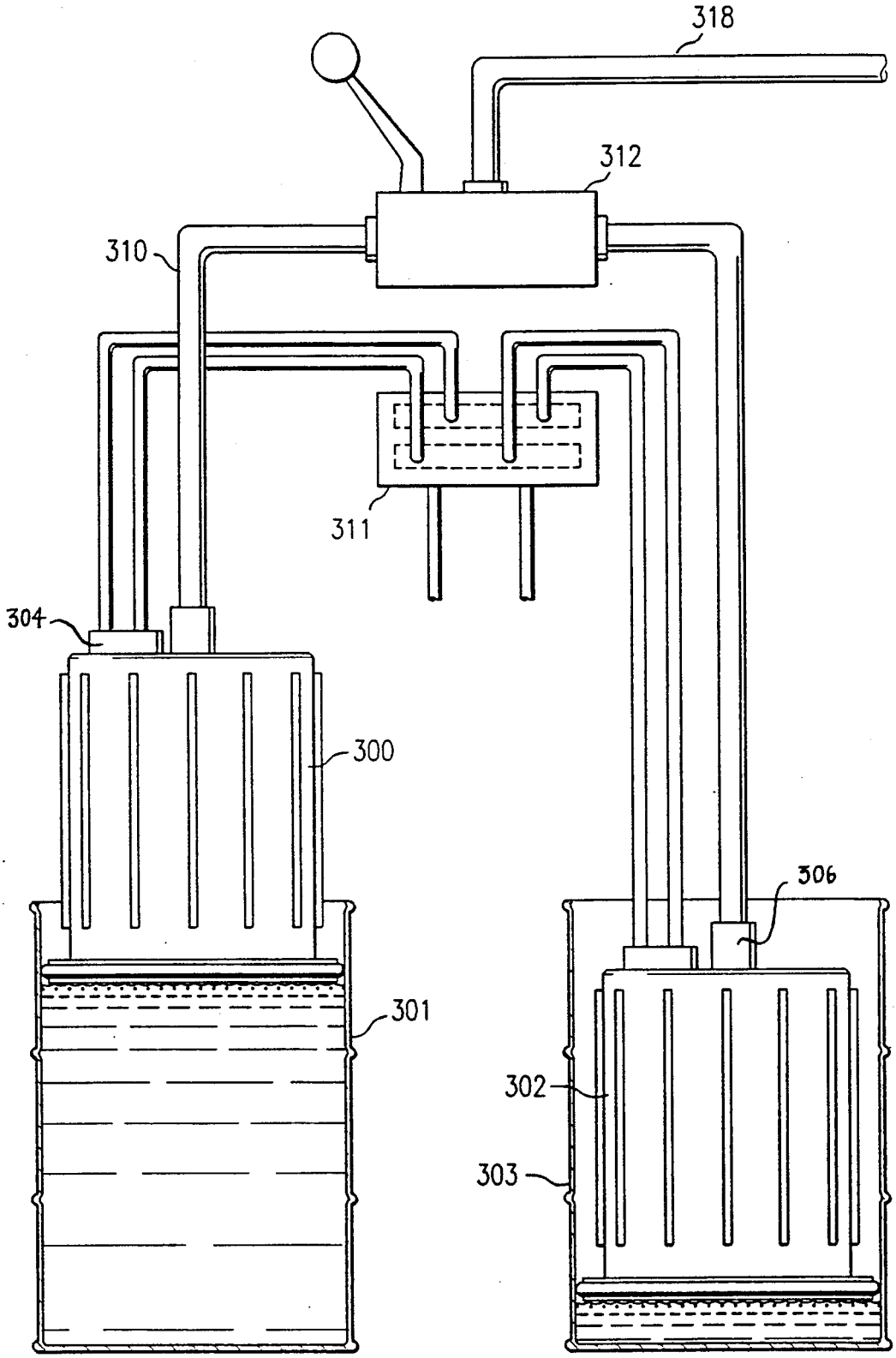
FIG. 5 is a schematic representation showing two viscous fluid pump systems in conjunction, processing viscous fluid from one container to another.

FIG. 5 schematically illustrates how two viscous fluid pumping systems can work in conjunction. Pumping system 300 is lowered into container 301 as pumping system 302 rests on the bottom of container 303. Pumping systems 300 and 302 are of the design of pumping system 10 described in FIGS. 1 through 4. When pumping system 300 is activated, fluid passes through the material processor pump, driven by hydraulic motor 304, to line 310 and through valve 312. Pumping system 302, and particularly its material processing pump, is run in reverse such that fluid enters the outlet 306 and passes through the meshed gears which are rotating oppositely from pump system 304. The recycled fluid passes from the inlet of system 302 and into the bottom of container 303. When all the material is pumped from container 301, the pumping systems 300 and 302 are stopped. The process can be repeated by using multiport valve 311 to reverse the rotation of the gears of the material process pumps in both systems 300 and 302. Thereby, system 302 would pump fluid from container 303 back into system 300. Valve 311 controls the hydraulics of both systems. If desired, valve 312 can be set to allow for the direct pumping of fluid to packaging using line 318.

Figure 6:
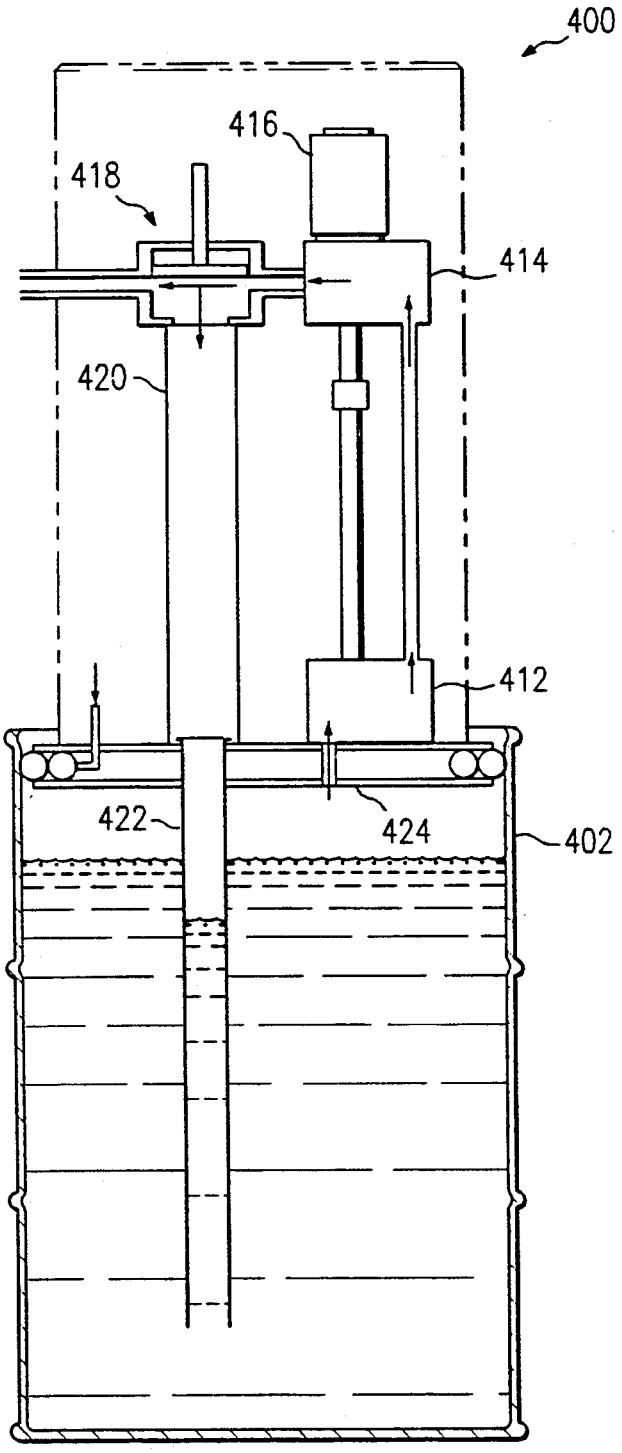
FIG. 6 is a schematic representation of the viscous fluid pumping system in which the viscous fluid is pumped back into the bottom of the fluid container.

FIG. 6 schematically illustrates the use of a single pumping system 400 to recirculate fluid within a single container 402. In the embodiment illustrated, pumping system 400 is comprised of two material processor pumps 412 and 414. Pumps 412 and 414 may be the design of the material processor pump 20 of FIG. 1. Alternatively, pump 414 may of such design with pump 414 being a booster pump for supplying high pressure to the material being discharged. Such a booster pump would have the standard gear pump teeth intermesh as is well known in the art. Both pumps are actuated by torque motor 416. Output from pump 412 is fed to the input for pump 414. Output from pump 414 is fed into a 3-way valve 418. Valve 418 directs flow to either a remote location or into valve chamber 420. As the fluid fills chamber 420, drop tube 422 is forced downward through a follower plate 424 and into the fluid in container 402. When the drop tube 422 is fully extended, fluid flows through the drop tube and into the bottom of chamber 402.

Figure 7:
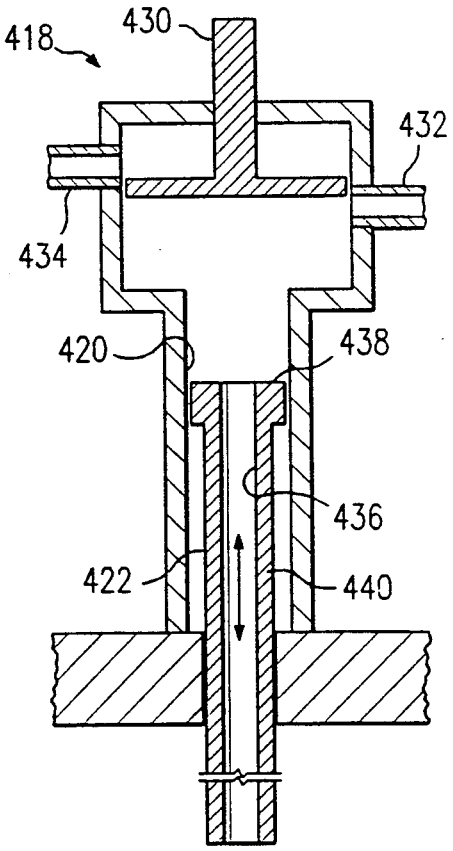
FIG. 7 is a detailed view of the valve system used in the embodiment shown in FIG. 6.

FIG. 7 depicts the drop tube valve 422 in greater detail. When in its up position, piston 430 allows direct flow from inlet 432 to a remote location via line 434. By moving valve 430 to the position shown in FIG. 7, flow from inlet 432 is directed into valve chamber 420 and into contact with drop tube 422 which is free floating within valve chamber 420. Passageway 436 is formed within drop tube 422. Drop tube 422 is comprised of top flange 438 with a tube 440 extending therefrom. Flange 438 has a greater diameter than tube 440, thereby creating a pressure differential between the inlet top of the drop tube and the outlet as fluid flows into valve chamber 420. This pressure differential drives the drop tube into the fluid in container 402. Thus, fluid pumped through drop tube 422 enters drum 402 near its bottom while fluid is withdrawn from the top. This provides complete circulation and processing of material throughout the drum.

Figure 8:
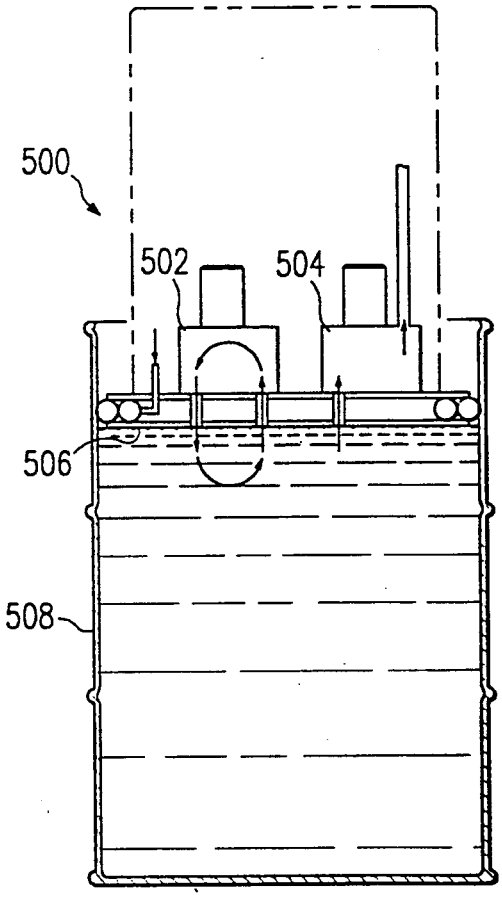
FIG. 8 is a schematic representation of an alternative embodiment of the invention using two process pumps on a single follower plate.

A further embodiment is shown in FIG. 8 wherein a pumping system 500 includes a pair of material processor pumps 502 and 504 mounted on a follower plate 506. The design of the material processor pumps 502 and 504 and follower plate 506 are of the design of corresponding components shown in the embodiments of FIGS. 1 through 4. In this arrangement, one pump, for example, material processor pump 502 is designed to simply circulate fluid which is taken from drum 58, process it through the gears of the process pump and then discharge it back into the tank of the drum. In this way, material that is semi-solid is immediately liquified and placed into the tank immediately below the follower plate and at the seal between the follower plate and drum 508. This acts to "wet and seal" and to provide the necessary seal therebetween. It has been found that without wetting the seal in this way, and particularly where semi-solid material is being pumped, leakage may occur between the seal and the drum and thereby reduce the effectiveness of the system.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements that fall within the scope of the invention.

I claim:

1. A viscous fluid pumping system to withdraw high viscosity fluid from a container while decreasing its viscosity comprising:

(a) a pump comprising:

(i) a housing defining a process chamber having an inlet for introducing the fluid therein and an outlet for discharging the fluid therefrom, and (ii) a pair of intermeshing process gears rotatable in said process chamber and designed such that a clearance can exist therebetween;

(b) a plate for placement over the fluid in the container and on which the pump is mounted, the plate having a periphery substantially corresponding to the interior of the container and a hole to allow communication of the inlet of the pump through the plate; and (c) a drive unit for rotating the gears to withdraw fluid from the container.

2. A viscous fluid pumping system to withdraw high viscosity fluid from a container while decreasing its viscosity comprising:

(a) a pump having an inlet and an outlet comprising:

(i) a housing defining a process chamber for receiving fluid from the inlet for introducing fluid therein and for discharging fluid therefrom through the outlet;

(ii) a drive process gear and a driven process gear in intermeshing relationship and rotatable in said process chamber, said area of intermesh being in a flow path between the inlet and outlet in the process chamber; and (iii) said drive and driven gears designed with a clearance therebetween such that the mesh between such gears during rotational speeds permits said driven gear to be forced ahead of and out of contact with said drive gear by fluid therebetween, thereby allowing fluid to flow from the discharge side to the inlet side of said gears through the intermesh;

(b) a plate for placement over the fluid in the container and on which the pump is mounted, the plate having a periphery substantially corresponding to the interior of the container and a hole to allow communication of the inlet of the pump through the plate;

(c) a seal for forming a seal between the periphery of said plate and the interior of said container; and (d) a drive unit for driving said pump to withdraw fluid from the container.

3. The pumping system according to claim 2 wherein said gears are rotated such that the fluid is introduced into the inlet and flows around the gears, between the gears and the corresponding sidewall of the process chamber, and recirculates through the intermesh area of the gears.

4. The pumping system according to claim 2 wherein the clearances between the gear teeth and the housing adjacent the inlet are greater than the clearance between the gear teeth and the housing adjacent the outlet.

5. The pumping system of claim 2 wherein said seal between the follower plate and the container comprises:

an elastomeric ring circumferentially disposed around said follower plate; and means to adjustable press said elastomeric ring against the interior of said container.

6. The pumping system of claim 5 wherein said means to adjustably press said O-ring against the interior of said container comprises:

an inflatable tube; and an air valve from said tube to permit adjustment of pressure therein.

7. The pumping system of claim 2 wherein said drive unit to said gear pump comprises a motor capable of exerting variable torque to the drive gear.

8. The pumping system of claim 2 further comprising a second pump mounted on the plate for drawing the fluid from the container, processing it and discharging it directly into the container.

9. The pumping system of claim 1 wherein a sufficient clearance is provided such that fluid can flow from the outlet to the inlet through the clearance between the gears during rotation of the gears.

10. The pumping system of claim 1 further comprising a seal for sealing between the periphery of the plate and the interior of the container.

11. The pumping system of claim 10 wherein said seal between the plate and the container comprises:

an elastomeric ring circumferentially disposed around the periphery of said plate; and means to adjustably press said elastomeric ring against the interior of said container.

12. The pumping system of claim 1 wherein said drive unit to said pump comprises a motor capable of exerting variable torque to at least one of the gears.

13. A viscous fluid pumping system for use with material in a container comprising:

(a) a material processor comprising:

(i) a housing defining a process chamber having an inlet for introducing the fluid therein and an outlet for discharging the fluid therefrom, and (ii) a pair of intermeshing process gears rotatable in said process chamber and designed such that a clearance can exist therebetween;

(b) a plate for placement over the material in the container and on which the material processor is mounted, the plate having a periphery substantially corresponding to the interior of the container and a hole to allow communication of the inlet of the pump through the plate;

(c) means for sealing between the periphery of the plate and the interior of said container; and (d) means for driving said material processor.

14. A viscous fluid pumping system for use with material in a container comprising:

(a) a material processor having an inlet for receiving fluid and an outlet for discharging fluid comprising:

(i) a gear assembly for rotating in a process chamber, the assembly having at least one pair of process gears driven in intermeshing operation, one said gear being the primary gear and the other the secondary gear;

(ii) a power source for driving said primary gear;

(iii) the process chamber defining the inlet for delivering material thereto and the outlet for discharging material therefrom; and (iv) said primary and secondary process gears designed with a clearance therebetween such that the mesh between said gears during selected rotational speeds provides a clearance therebetween such that the secondary gear is ahead of and out of continuous contact with the primary gear with a quantity of material positioned therebetween, thereby permitting the flow of material through the intermeshing gears from the outlet side to the inlet side of said gears subjecting said material to processing;

(b) a plate for placement over the material in the container and on which the material processor is mounted, the plate having a periphery substantially corresponding to the interior of the container and a hole to allow communication of the inlet of the pump through the plate;

(c) means for sealing between the periphery of the plate and the interior of said container; and (d) means for driving said material processor.

15. The material processor of claim 14 further comprising a second material processor of identical design and mounted for movement with said plate, said second material processor for drawing material from the container, processing it and discharging it directly into the container.

16. The material processor according to claim 14 wherein said gears are rotated such that material is introduced into the inlet and flows around the gears between the gears and the corresponding sidewall of the process chamber, and recirculates through the intermesh area of the gears.

17. The material processor according to claim 16 wherein the clearance between the gear teeth and the housing adjacent the inlet are greater than the clearances between the gear teeth and the housing adjacent the outlet.

18. The pumping system of claim 14 wherein said means for sealing between the periphery of the plate and the interior of said container comprises:

an elastomeric O-ring circumferentially located around the periphery of said plate; and an inflatable tube circumferentially located between said O-ring and said plate.

19. The pumping system of claim 14 wherein said means to drive said material processor comprises an electric, variable-torque motor.

20. A viscous fluid pumping system for circulating material between containers comprising:

a first pump mounted on a plate, said plate for placement over the material in a first container;

a second pump mounted on the plate, said plate for placement over the material in a second container, said first and second pumps being driveable in forward and reverse directions;

means for connecting the outputs of the first pump and the second pump; and means for reversing the direction of flow between the first and second pumps such that as the material moves in a first direction it is discharged from the first pump to and through the second pump, and on reversal, the material is discharged from the second pump to and through the first.

21. The pumping system of claim 20 wherein said means to direct the output comprises a hydraulic line.

22. The pumping system of claim 21 further comprising a 3-way valve located in said hydraulic line to selectively direct the output from either pump.

23. The pumping system of claim 20 wherein said means to reverse the direction of said flow comprises a switch that activates the second pump while deactivating the first pump.

24. The pumping system of claim 20 wherein said means to reverse the direction of said flow further comprises a switch for activating the first pump for driving in one direction while activating the second pump to drive in the opposite direction.

25. A viscous fluid pumping system for recirculating a material within a container comprising:

a pump unit with an inlet and an output;

a plate for placement over the material in the container and on which said pump unit is mounted with the inlet exposed to the interior of the container through a hole in the plate;

a seal for sealing between said plate and the interior of said container;

means to drive said pump unit;

a valve connected to the output of the modified gear pump comprising:

a chamber;

an inlet for receiving fluid from the output of the pump unit; and an extendable drop tube positioned within said chamber and designed to telescope into said container to a point removed from said pump inlet upon the loading of fluid into the valve from said pump unit.

* * * * *